US012331969B2

(12) United States Patent
Choi et al.

(10) Patent No.: US 12,331,969 B2
(45) Date of Patent: Jun. 17, 2025

(54) AIR CONDITIONER

(71) Applicant: LG ELECTRONICS INC., Seoul (KR)

(72) Inventors: Woojoo Choi, Seoul (KR); Yejin Kim, Seoul (KR); Eunjun Cho, Seoul (KR); Jihyeong Ryu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 263 days.

(21) Appl. No.: 17/949,532

(22) Filed: Sep. 21, 2022

(65) Prior Publication Data

US 2023/0094976 A1 Mar. 30, 2023

(30) Foreign Application Priority Data

Sep. 24, 2021 (KR) ..... 10-2021-0126522

(51) Int. Cl.

| | |
|---|---|
| ***F25B 49/02*** | (2006.01) |
| ***F24F 5/00*** | (2006.01) |
| ***F25B 31/00*** | (2006.01) |
| ***F25B 41/20*** | (2021.01) |
| ***F25B 41/40*** | (2021.01) |

(52) U.S. Cl.

CPC ..... *F25B 41/20* (2021.01); *F24F 5/001* (2013.01); *F25B 31/00* (2013.01); *F25B 41/40* (2021.01); *F25B 49/02* (2013.01); *F25B 2313/02743* (2013.01); *F25B 2700/21* (2013.01)

(58) Field of Classification Search

CPC ..... F25B 41/20; F25B 41/40; F25B 31/00; F25B 49/02; F25B 2700/21; F24F 5/001

See application file for complete search history.

(56) References Cited

U.S. PATENT DOCUMENTS

2015/0300714 A1* 10/2015 Ishimura ..... F25B 49/02 62/228.1
2016/0116191 A1* 4/2016 Tamaki ..... F25B 47/025 62/160

FOREIGN PATENT DOCUMENTS

| | | |
|---|---|---|
| EP | 3611439 | 2/2020 |
| GB | 2524673 | 9/2015 |
| JP | 11-063661 | 3/1999 |
| JP | 2007-010242 | 1/2007 |
| JP | 2018-036002 | 3/2018 |
| KR | 10-2015-0129571 | 11/2015 |
| KR | 10-2019-0081855 | 7/2019 |
| KR | 10-2021-0093560 | 7/2021 |

OTHER PUBLICATIONS

European Search Report issued in Application No. 22196671.6 dated Jan. 30, 2023.
Koran Office Action issued in Application No. 10-2021-0126522 dated Mar. 29, 2023.

* cited by examiner

*Primary Examiner* — Nael N Babaa
(74) *Attorney, Agent, or Firm* — KED & ASSOCIATES

(57) ABSTRACT

An air conditioner and a method for controlling an air conditioner. The method may include detecting an outlet temperature of a compressor; detecting a change in temperature of a hot water supply pipe; determining a system error based on the outlet temperature of the compressor; and determining an abnormality in an adjustment valve based on the temperature of the hot water supply pipe when a system error is determined.

16 Claims, 12 Drawing Sheets

AIR CONDITIONER

CROSS-REFERENCE TO RELATED APPLICATION(S)

This application claims priority under 35 U.S.C. § 119 to Korean Application No. 10-2021-0126522 filed in Korea on Sep. 24, 2021, whose entire disclosure is hereby incorporated by reference.

BACKGROUND

1. Field

An air conditioner that detects an abnormality in an adjustment valve and performs an operation to solve the abnormality is disclosed herein.

2. Background

Generally, air conditioning systems are used to cool or heat confined spaces, for example, rooms in a building. In such an air conditioning system, refrigerant is circulated between an indoor unit and an outdoor unit such that the refrigerant absorbs ambient heat while evaporating from a liquid phase, and discharges the absorbed heat while condensing from a gaseous phase. In accordance with such characteristics of the refrigerant, the air conditioning system performs a cooling or heating operation.

In a typical air conditioning system, one indoor unit is installed for one outdoor unit. However, recently, the use of an air conditioning system in the form of a cooling and heating concurrent type air conditioning system has increased. In the cooling and heating concurrent type air conditioning system, a plurality of indoor units having various structures and various capacities are connected to one or more outdoor units, in order to perform a cooling or heating operation for an area where there are a plurality of separated spaces, such as in a school, a company, or a hospital, for example.

In such a cooling and heating concurrent type air conditioning system, the number of indoor units is greater than the number of outdoor units, and each indoor unit in a space in which each indoor unit is installed has a different air conditioning load depending on a purpose of the space, a number of people to be accommodated, and a size. In addition, a cooling and heating concurrent type air conditioning system according to the related art is implemented using a plurality of solenoid valves to implement a hot water supply mode, a cooling and hot water supply mode, and a heating and hot water supply mode, for example.

However, when the air conditioning system is implemented as described above, in the event of leaking of the solenoid valve, an abnormal cycle may occur due to liquid accumulated in a non-operating unit and a reduced amount of circulating refrigerant, and there is no means to detect an abnormality in the solenoid valves. In addition, in the event of the abnormality in the solenoid valves, there is no choice but to stop the system so as to repair the air conditioner by a repair technician.

BRIEF DESCRIPTION OF THE DRAWINGS

Embodiments will be described in detail with reference to the following drawings in which like reference numerals refer to like elements, and wherein.

DETAILED DESCRIPTION

Figure 1:
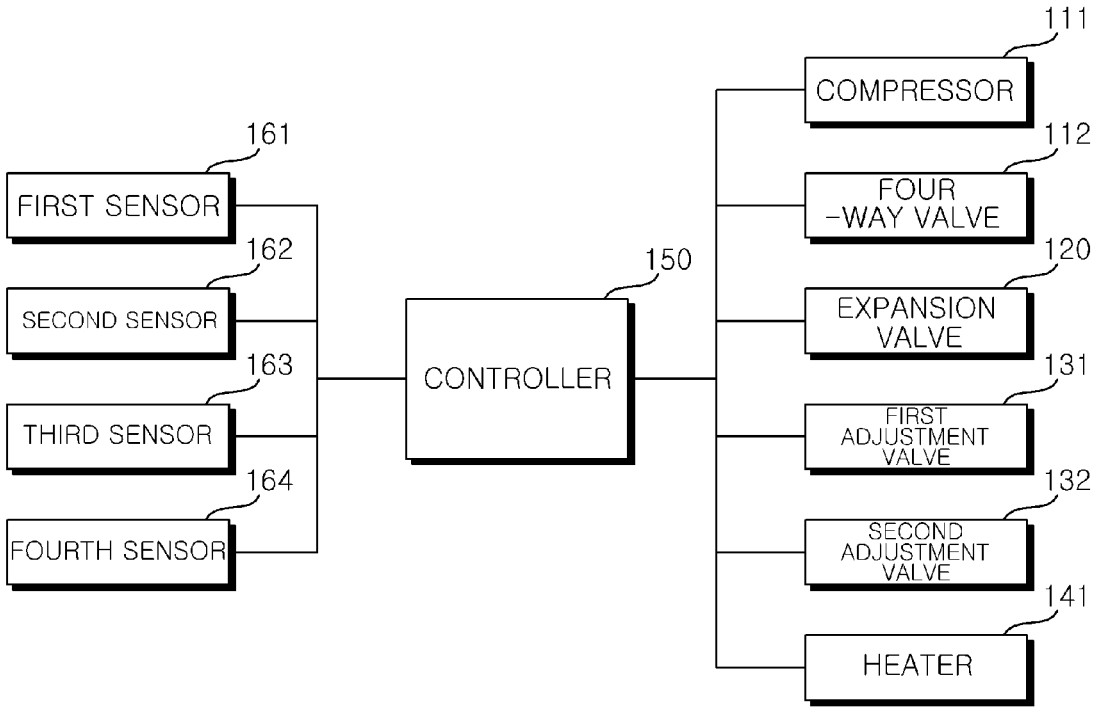
FIG. 1 is a control block diagram of an air conditioner according to an embodiment.

Advantages and features of embodiments and methods for achieving those of the embodiments will become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope. The same reference numerals may refer to the same elements throughout the specification.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used herein is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and herein, and will not be interpreted in an idealized or overly formal sense unless expressly so defined herein.

In the drawings, a thickness or size of each layer is exaggerated, omitted, or schematically illustrated for convenience of description and clarity. Also, the size or area of each constituent element does not entirely reflect the actual size thereof.

Hereinafter, embodiments will be described with reference to the accompanying drawings.

Figure 2:
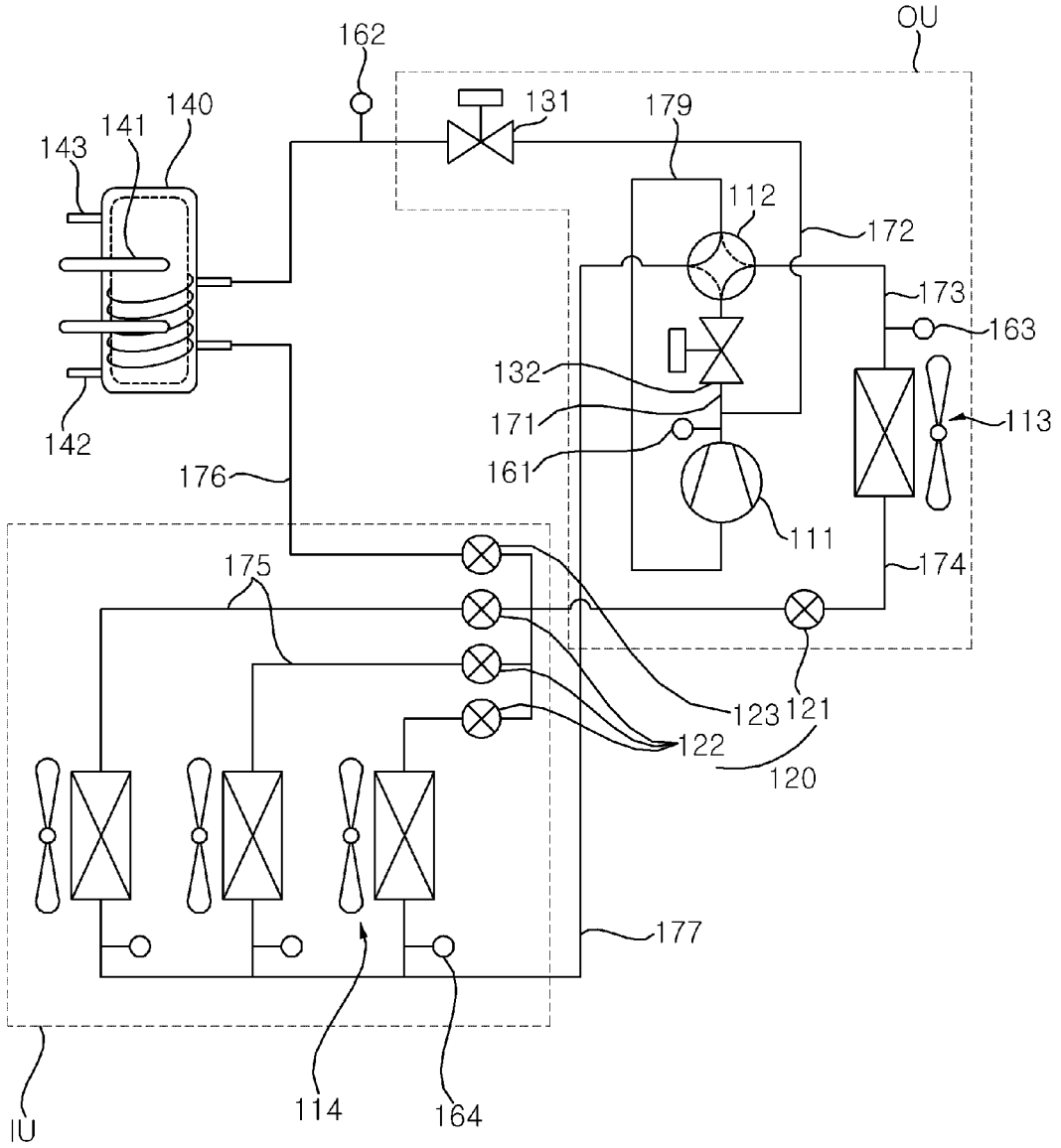
FIG. 2 is a block diagram of an air conditioner according to an embodiment.

Referring to FIGS. 1 and 2, an air conditioner according to an embodiment may include a compressor 111, an indoor heat exchanger 114, an outdoor heat exchanger 113, a water tank 140, and a first adjustment valve 131, a second adjustment valve 132, a first sensor 161, a second sensor 162, a switching part, and a controller 150. The switching part may include a four-way valve 112.

The indoor heat exchanger 114 functions as an evaporator that evaporates a refrigerant in a cooling operation, and as a condenser that condenses a refrigerant in a heating operation. A plurality of the indoor heat exchanger 114 may be provided. The indoor heat exchanger 114 may be accommodated in an indoor unit (IU). The outdoor heat exchanger 113 functions as a condenser that condenses a refrigerant in a cooling operation and as an evaporator that evaporates a refrigerant in a heating operation.

The compressor 111 compresses low-temperature and low-pressure refrigerant having passed through the evaporator at high temperature and high pressure. The compressor 111 may have any of various structures. For example, the compressor 111 may be a reciprocating compressor using a cylinder and a piston, a scroll compressor using a spiral scroll and a fixed scroll, or an inverter compressor capable of adjusting an amount of compression of refrigerant based on an operating frequency, for example. However, a scroll compressor is used in this embodiment.

The compressor 111 may include a plurality of compression chambers having different internal pressures. For example, the compressor 111 may include a first compression chamber (not shown) in which refrigerant having passed through an evaporator is compressed, and a second compression chamber (not shown) in which the refrigerant discharged from the first compression chamber is compressed. However, the number of compression chambers is not limited thereto.

The compressor 111 may be connected to the four-way valve 112. In the compressor 111, refrigerant evaporated by the indoor heat exchanger 114 is introduced in a cooling operation, or refrigerant evaporated by the outdoor heat exchanger 113 is introduced in a heating operation.

The four-way valve 112 is a flow-path switching valve that switches a flow path of refrigerant in the heating and cooling operations. The four-way valve 112 guides refrigerant compressed by the compressor 111 to the outdoor heat exchanger 113 in the cooling operation and to the indoor heat exchanger 114 in the heating operation.

One or a first side of the four-way valve 112 may be connected to a discharge side of the compressor 111 and a first connection pipe 171. The other or a second side of the four-way valve 112 may be connected to the four-way valve 112 and a second connecting pipe 179. One or a first side of the outdoor heat exchanger 113 may be connected to the four-way valve 112 and the third connection pipe 173, and the other or a second end of the outdoor heat exchanger 113 may be connected to the indoor heat exchanger 114, the water tank 140, and a fourth connection pipe 174.

A plurality of indoor heat exchangers 114 may be connected to the water tank 140, the outdoor heat exchanger 113, and the four-way valve 112. One or a first side of the plurality of indoor heat exchangers 114 may be connected to a plurality of first indoor unit pipes 175, and the plurality of first indoor unit pipes 175 may be connected to the fourth connection pipe 174. The other side of the plurality of indoor heat exchangers 114 may be connected to a second indoor unit pipe 177, and the second indoor unit pipe 177 may be connected to the four-way valve 112.

The water tank 140 may perform heat-exchange with high-temperature refrigerant discharged through the compressor 111 to generate and provide hot water. In the water tank 140, a heater 141 that heats water in the water tank 140 may be disposed.

The water tank 140 may be connected to a place where the hot water is used (not shown). The water tank 140 may be connected to the place where the hot water is used, a hot water inlet pipe 142, and a hot water outlet pipe 143.

The water tank 140 may be connected to the compressor 111. The water tank 140 may be connected to the indoor heat exchanger 114 and the outdoor heat exchanger 113.

More specifically, one or a first side of the water tank 140 may be connected to the compressor 111 and a first hot water supply pipe 172. One or a first end of the first hot water supply pipe 172 may be connected to the water tank 140, and the other or a second end of the first hot water supply pipe 172 may be connected to the first connection pipe 171. The other or a second side of the water tank 140 and the fourth connecting pipe 174 may be connected to a second hot water supply pipe 176.

The first adjustment valve 131 may be controlled so that refrigerant compressed by the compressor 111 is selectively supplied to the water tank 140. The first adjustment valve 131 may be disposed at the first hot water supply pipe 172. The first adjustment valve 131 may be configured as a solenoid valve or an electromagnetic expansion valve, for example.

The second adjustment valve 132 may be controlled so that refrigerant compressed by the compressor 111 is selectively supplied to the four-way valve 112. The second adjustment valve 132 may be disposed at the first connection pipe 171. The second adjustment valve 132 may be configured as a solenoid valve or an electromagnetic expansion valve, for example. The second adjustment valve 132 may be disposed between the four-way valve 112 and a connection point of the first hot water supply pipe 172 and the first connection pipe 171.

The expansion valve 120 may expand refrigerant and an opening degree of the expansion valve 120 may be adjusted. A plurality of the expansion valve 120 may be provided. The expansion valve 120 may include an outdoor unit expansion valve 121, an indoor unit expansion valve 122, and a hot water supply expansion valve 123.

The outdoor unit expansion valve 121 may be connected to the outdoor heat exchanger 113, the indoor unit expansion valve 122 may be connected to the indoor heat exchanger 114, and the hot water supply expansion valve 123 may be connected to the water tank 140. More specifically, the outdoor unit expansion valve 121 may be disposed at the fourth connecting pipe 174, the indoor unit expansion valve 122 may be disposed at each of the plurality of first indoor unit pipes 175, and the hot water supply expansion valve 123 may be disposed at the second hot water supply pipe 176.

The air conditioner may include a plurality of sensors for control operation. First sensor 161 to fourth sensor 164 each may include a temperature sensor or a pressure sensor. The first sensor 161 to the fourth sensor 164 each may provide a temperature value by substituting pressure for temperature, or may provide a temperature value itself.

The first sensor 161 may detect a temperature of refrigerant discharged from the compressor 111. The first sensor 161 may be disposed at the first connection pipe 171.

The second sensor 162 may detect a temperature of refrigerant supplied to the water tank 140. The second sensor 162 may be disposed at the first hot water supply pipe 172.

The third sensor 163 may detect a temperature of refrigerant passing through the outdoor heat exchanger 113. The third sensor 163 may be disposed at the third connection pipe 173.

The fourth sensor 164 may detect a temperature of refrigerant passing through the indoor heat exchanger 114. The fourth sensor 164 may be disposed at the second indoor unit pipe 177.

The controller 150 may control the compressor 111, the four-way valve 112, the expansion valve, the first adjustment valve 131, the second adjustment valve 132, and the heater 141. The controller 150 may operate the air conditioner in any one of a cooling operation mode, a cooling and hot water supply operation mode, a hot water supply operation mode, a heating operation mode, a heating and hot water supply operation mode, and a hot water supply operation, for example, based on temperature values input from the first sensor 161 to the fourth sensor 164.

Hereinafter, a use state according to each mode of the air conditioner will be described with reference to FIGS. 3 to 7.

Figure 3:
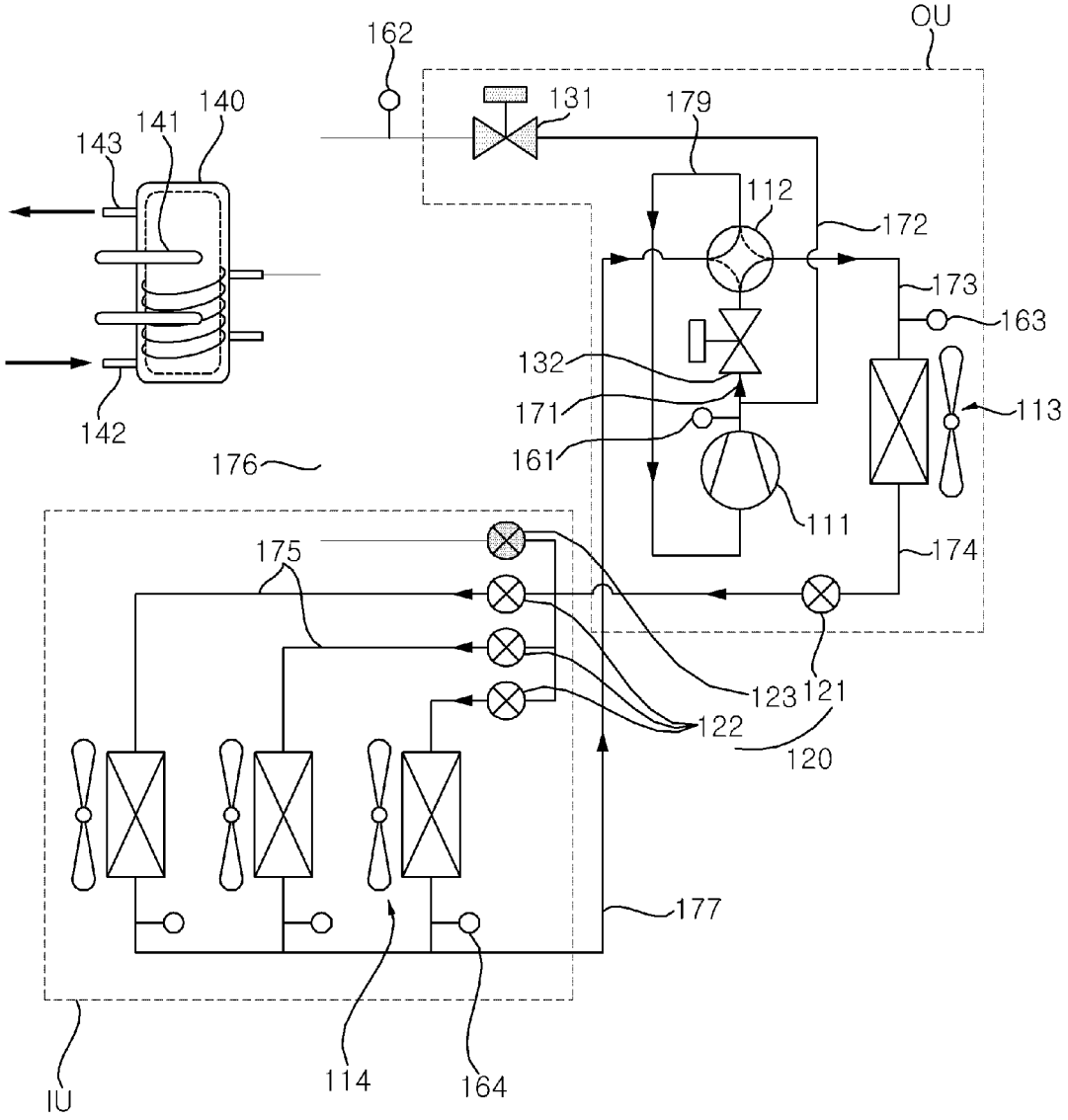
FIG. 3 is a use state diagram illustrating a first mode of the air conditioner shown in FIG. 2.

FIG. 3 is a use state diagram illustrating a first mode of the air conditioner shown in FIG. 2. More specifically, FIG. 3 shows an embodiment implemented in a cooling operation mode of the air conditioner.

In the cooling operation mode, the first adjustment valve 131 is closed, the second adjustment valve 132 is opened, the hot water supply expansion valve 123 is closed, the opening degree of the outdoor unit expansion valve 121 is adjusted to throttle refrigerant, and the indoor unit expansion valve 122 is fully opened. The four-way valve 112 supplies refrigerant compressed by the compressor 111 to the outdoor heat exchanger 113 and supplies refrigerant discharged from the indoor heat exchanger 114 to the compressor 111.

In this case, the outdoor heat exchanger 113 operates as a condenser, and the indoor heat exchanger 114 operates as an evaporator. As the first adjustment valve 131 is closed, refrigerant is not supplied to the water tank 140.

Figure 4:
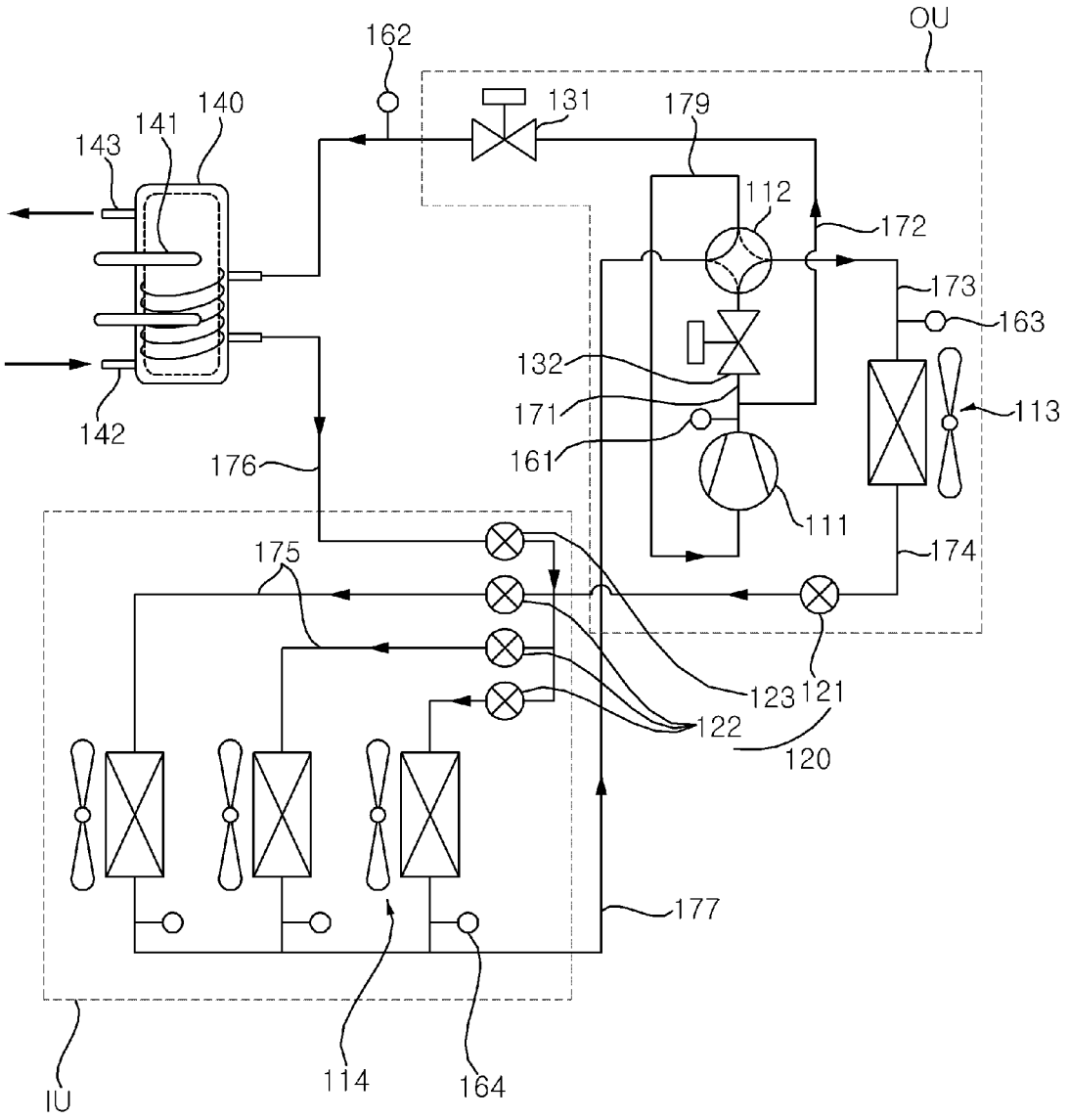
FIG. 4 is a use state diagram illustrating a second mode of the air conditioner shown in FIG. 2.

FIG. 4 is a use state diagram illustrating a second mode of the air conditioner shown in FIG. 2. More specifically, FIG. 4 shows an embodiment implemented in a cooling and hot water supply operation mode of the air conditioner.

In the cooling and hot water supply operation mode, the first adjustment valve 131 is opened, the second adjustment valve 132 is opened, and opening values of the hot water supply expansion valve 123 and the outdoor unit expansion valve 121 are adjusted to throttle refrigerant. The indoor unit expansion valve 122 is fully opened. The four-way valve 112 supplies refrigerant compressed by the compressor 111 to the outdoor heat exchanger 113 and supplies refrigerant discharged from the indoor heat exchanger 114 to the compressor 111.

In this case, the outdoor heat exchanger 113 operates as a condenser, and the indoor heat exchanger 114 operates as an evaporator. The first adjustment valve 131 is opened to supply high-temperature refrigerant to the water tank 140 to exchange heat with the water in the water tank 140.

Figure 5:
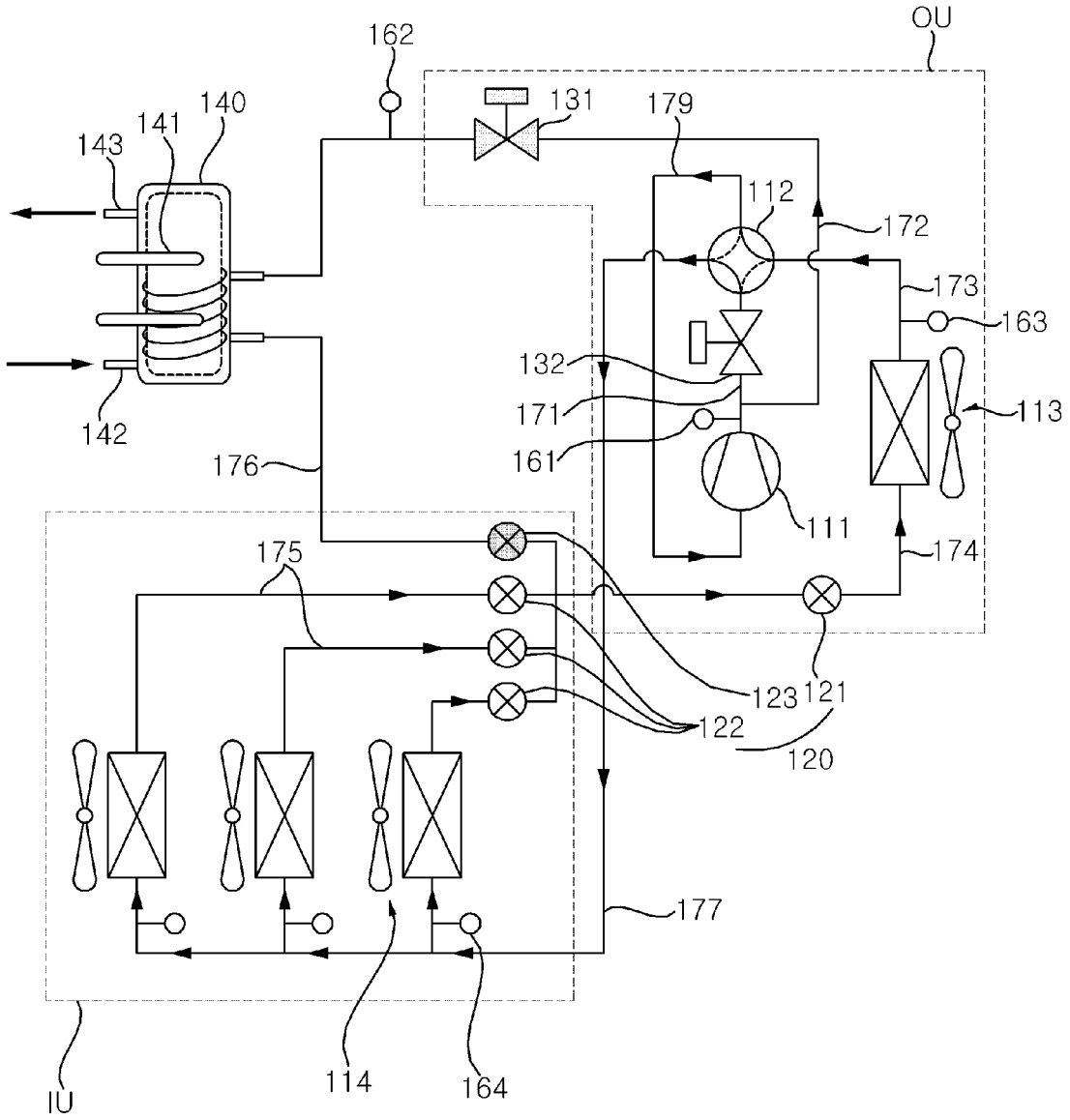
FIG. 5 is a use state diagram illustrating a third mode of the air conditioner shown in FIG. 2.

FIG. 5 is a use state diagram illustrating a third mode of the air conditioner shown in FIG. 2. More specifically, FIG. 5 shows an embodiment implemented in a heating operation mode of the air conditioner.

In the heating operation mode, the first adjustment valve 131 is closed, the second adjustment valve 132 is opened, the hot water supply expansion valve 123 is closed, the opening value of the indoor unit expansion valve 122 is adjusted to throttle refrigerant, and the outdoor unit expansion valve 121 is fully opened. The four-way valve 112 supplies the refrigerant compressed by the compressor 111 to the indoor heat exchanger 114, and supplies the refrigerant discharged from the outdoor heat exchanger 113 to the compressor 111.

In this case, the outdoor heat exchanger 113 operates as an evaporator, and the indoor heat exchanger 114 operates as a condenser. As the first adjustment valve 131 is closed, refrigerant is not supplied to the water tank 140.

Figure 6:
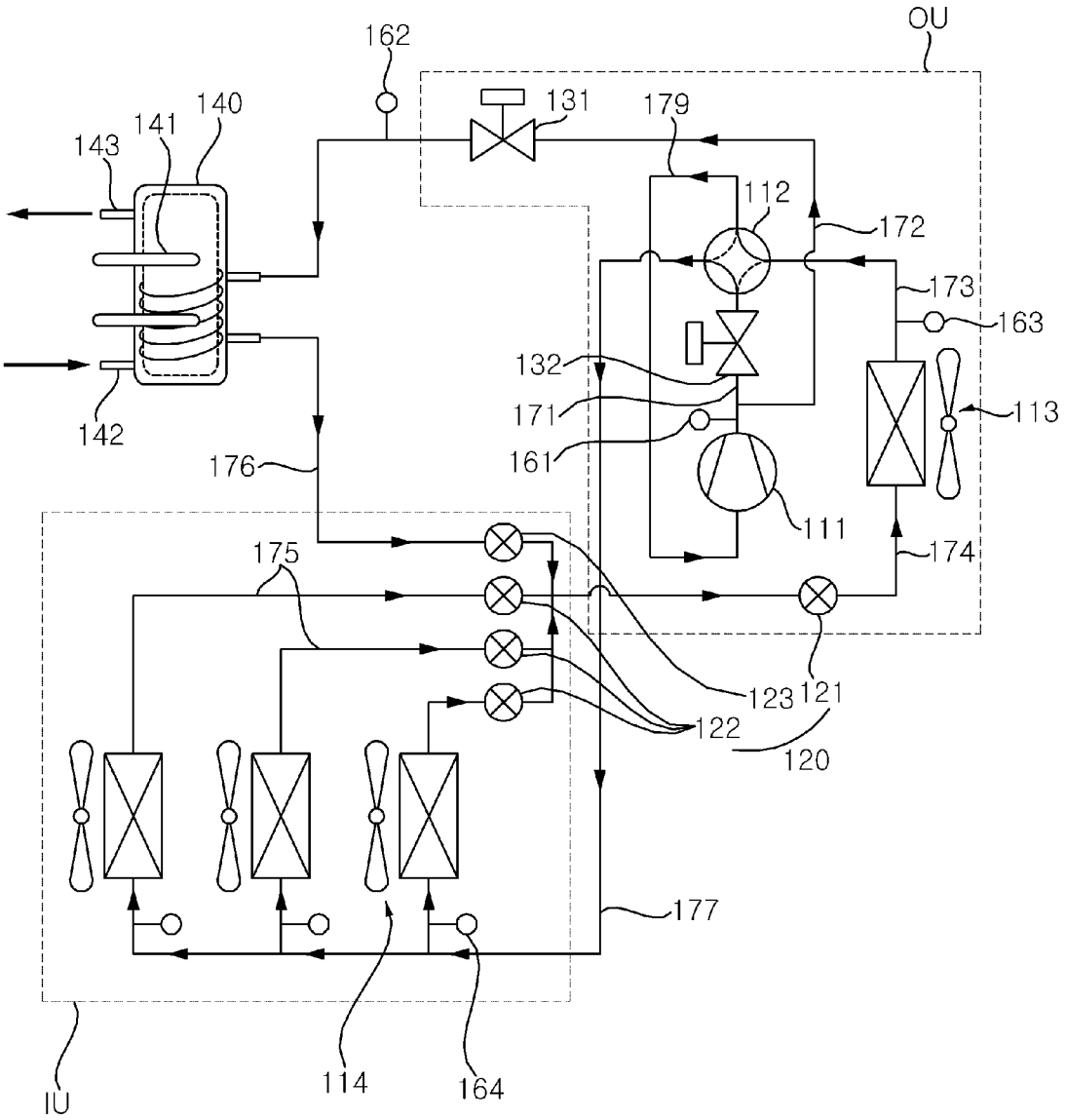
FIG. 6 is a use state diagram illustrating a fourth mode of the air conditioner shown in FIG. 2.

FIG. 6 is a use state diagram illustrating a fourth mode of the air conditioner shown in FIG. 2. More specifically, FIG. 6 shows an embodiment implemented in a heating/hot water supply operation mode of the air conditioner.

In the heating and hot water supply operation mode, the first adjustment valve 131 is opened, the second adjustment valve 132 is opened, and the opening values of the hot water supply expansion valve 123 and the indoor unit expansion valve 122 are adjusted to throttle the refrigerant. The outdoor unit expansion valve 121 is fully opened. The four-way valve 112 supplies the refrigerant compressed by the compressor 111 to the indoor heat exchanger 114, and supplies the refrigerant discharged from the outdoor heat exchanger 113 to the compressor 111.

In this case, the outdoor heat exchanger 113 operates as an evaporator, and the indoor heat exchanger 114 operates as a condenser. The first adjustment valve 131 is opened to supply high-temperature refrigerant to the water tank 140 to exchange heat with the water in the water tank 140.

Figure 7:
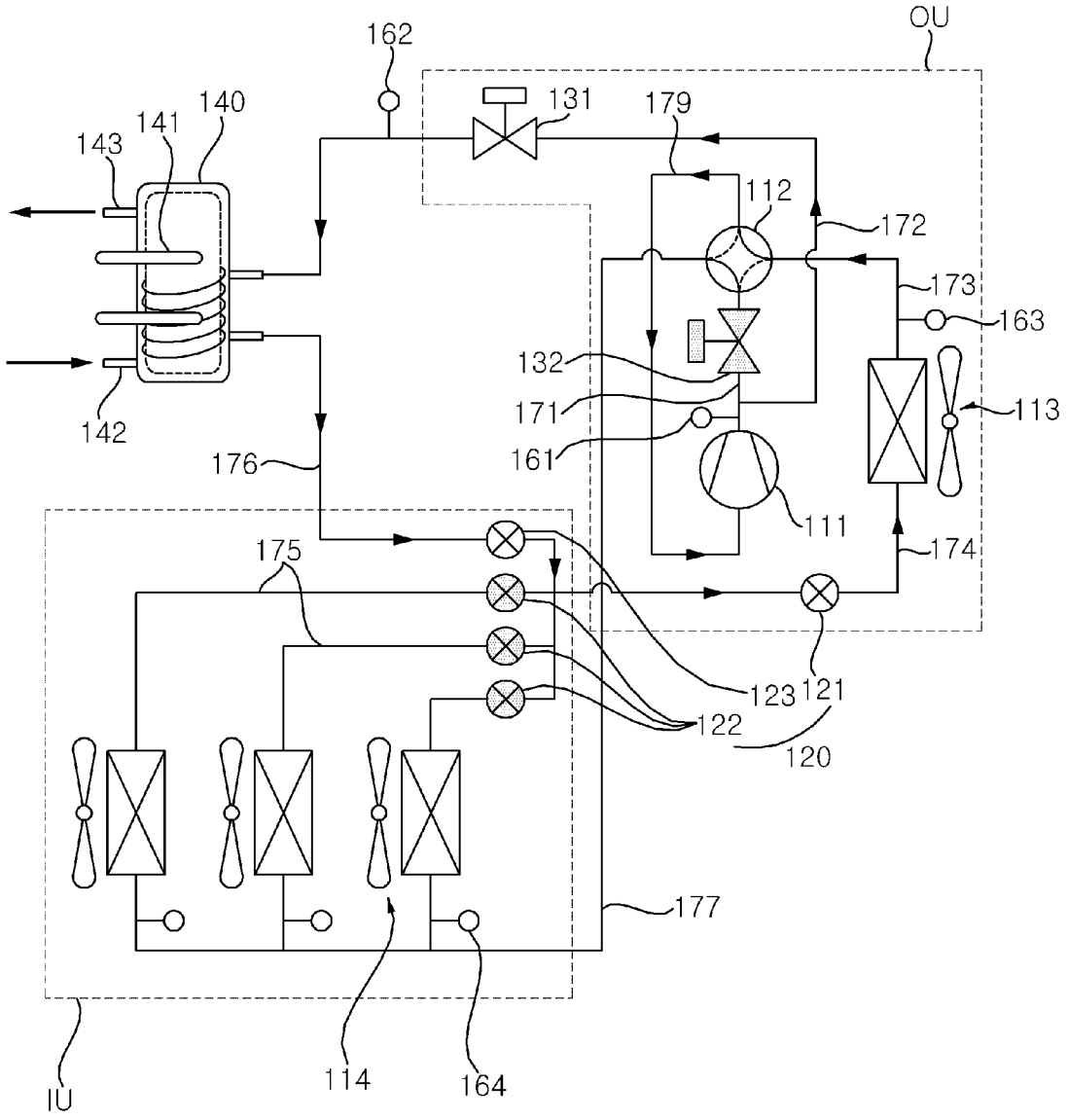
FIG. 7 is a use state diagram illustrating a fifth mode of the air conditioner shown in FIG. 2.

FIG. 7 is a use state diagram illustrating a fifth mode of the air conditioner shown in FIG. 2. More specifically, FIG. 7 shows an embodiment implemented in a hot water supply operation mode of the air conditioner.

In the hot water supply operation mode, the first regulating valve 131 is opened, the second regulating valve 132 is closed, the opening degree of the hot water supply expansion valve 123 is adjusted to throttle refrigerant, the outdoor unit expansion valve 121 is fully opened, and the indoor unit expansion valve 122 is closed. The four-way valve 112 supplies refrigerant discharged from the outdoor heat exchanger 113 to the compressor 111. In this case, the outdoor heat exchanger 113 operates as an evaporator, and the water tank 140 operates as a condenser. High-temperature refrigerant compressed by the compressor 111 is condensed while exchanging heat with hot water in the water tank 140.

Again, referring to FIGS. 2 and 3, operation of the controller 150 according to embodiments will be described.

The controller 150 may determine a system error and an abnormality in an adjustment valve based on at least one of temperature values input from the first sensor to the fourth sensor 164. Thus, embodiments have the advantage of being able to quickly and simply detect an error in the adjustment valves using only a temperature value.

More specifically, the controller 150 may determine an abnormality in the first adjustment valve 131 and the second adjustment valve 132 based on the respective temperature values input from the first sensor 161 and the second sensor 162. In addition, the controller 150 may control at least one of the first adjustment valve 131, the second adjustment valve 132, or the compressor 111 based on the respective temperature values input from the first sensor 161 and the second sensor 162.

When a temperature value input from the first sensor 161 is greater than a first reference temperature value, the controller 150 may stop the compressor 111. In a case in which a discharge temperature of the compressor 111 is higher than a reference value, serious damage to the air conditioner may be caused when the compressor 111 is continuously operated, and thus, the compressor 111 is stopped.

In addition, when the temperature value input from the first sensor 161 is greater than the first reference temperature value, the controller 150 may determine whether the adjustment valves operate abnormally according to a corresponding operation mode based on a temperature value input from the second sensor 162. When it is determined that the adjustment valves operate abnormally, the controller 150 may control to perform an adjustment valve counter-error operation.

Therefore, in embodiments disclosed herein, an abnormality in an adjustment valve may be determined according to each operation mode and an adjustment valve counter-error operation may be performed according to each operation mode, so it is not necessary to stop the system due to errors in all adjustment valves, thereby reducing inconvenience to consumers. There is an advantage of being able to perform a counter-error operation to solve the error while protecting the air conditioner in various situations occurring in each operation mode.

In addition, embodiments disclosed herein do not stop the system in the case of a problem which can be solved by software according to each operation mode, but instead lets the software solve the problem, thereby improving user convenience and reducing repair costs.

In the adjustment valve counter-error operation, the controller 150 may adjust the second adjustment valve 132 in accordance with a command for the first adjustment valve 131 and may adjust the first adjustment valve 132 in accordance with a command for the second adjustment valve 132. The adjustment valve counter-error operation means that the controller 150 adjusts the second adjustment valve 132, rather than the first adjustment valve 131, in accordance with a system command or user command for the first adjustment valve 131 and the first adjustment valve 131, rather than the second adjustment valve 132, in accordance with a command for the second adjustment valve 132. Therefore, with this software change, it is possible to solve the problem that the installer erroneously connects the first adjustment valve 131 and the second adjustment valve 132.

The adjustment valve counter-error operation may include stopping the air conditioner by the controller 150. In this case, the adjustment valve error is recognized as a problem that cannot be solved by software, so the air conditioner is stopped.

The adjustment valve counter-error operation may include restarting the air conditioner by the controller 150. The controller 150 determines that the error in the adjustment valves can be solved by restarting the air conditioner, so the controller 150 restarts the air conditioner.

For example, when the temperature value input from the first sensor 161 is greater than the first reference temperature value and the temperature value input from the second sensor 162 is out of the normal temperature range, the controller 150 may adjust the second adjustment valve 132 in accordance with a command for the first adjustment valve 131 and adjust the first adjustment valve 131 in accordance with a command for the second adjustment valve 132. More specifically, in the cooling operation mode and heating operation mode, when the temperature value input from the first sensor 161 is greater than the first reference temperature value and the temperature value input from the second sensor 162 is out of the normal temperature range, the controller 150 may adjust the second adjustment valve 132 in accordance with a command for the first adjustment valve 131 and adjust the first adjustment valve 131 in accordance with a command for the second adjustment valve 132. Therefore, with this software change, it is possible to solve the problem that the installer erroneously connects the first adjustment valve 131 and the second adjustment valve 132.

In the cooling operation mode, when the temperature value input from the first sensor 161 is greater than the first reference temperature value, the temperature value input from the second sensor 162 is within the normal temperature range, and the third temperature value input from the sensor 163 is within the normal temperature range, the controller 150 may stop the air conditioner. In this case, the controller 150 may determine that the problem cannot be solved by software, so the controller 150 may stop the air conditioner and notify a user terminal (not shown).

In the cooling operation mode, when the temperature value input from the first sensor 161 is greater than the first reference temperature value, the temperature value input from the second sensor 162 is within the normal temperature range, and the third temperature value input from the sensor 163 is out of the normal temperature range, the controller 150 may restart the air conditioner. In this case, the controller 150 determines that the problem can be solved by restarting the air conditioner, so the controller 150 restarts the air conditioner.

In another example, when the temperature value input from the first sensor 161 is greater than the first reference temperature value, the temperature value input from the second sensor 162 is within the normal temperature range, and the temperature value input from the fourth sensor 164 is within the normal temperature range, the controller 150 may stop the air conditioner.

In the heating operation mode, when the temperature value input from the first sensor 161 is greater than the first reference temperature value, the temperature value input from the second sensor 162 is the normal temperature range, and the temperature value input from the sensor 164 is out of the normal temperature range, the controller 150 may restart the air conditioner.

In another example, when the temperature value input from the first sensor 161 is less than the first reference temperature value, the controller 150 may determine, based on the temperature value input from the second sensor 162, whether the adjustment valves operate abnormally according to each operation mode, and when an abnormality in the adjustment valves is determined, the controller 150 may control to perform refrigerant circulation operation according to each operation mode. The refrigerant circulation operation may be to open the hot water supply expansion valve.

More specifically, in the cooling operation mode or heating operation mode, when the temperature value input from the first sensor 161 is less than the first reference temperature value and the temperature value input from the second sensor 162 is out of the normal temperature range, the controller 150 may control to perform the refrigerant circulation operation. If refrigerants is accumulated in the water tank 140 due to a malfunction of an adjustment valve and the refrigerant is insufficient in the overall air conditioner, efficiency of the system is reduced. More specifically, in the cooling operation mode or the heating operation mode, when the temperature value input from the first sensor 161 is greater than the first reference temperature value and the temperature value input from the second sensor 162 is out of the normal temperature range, the controller 150 may control the hot water expansion valve to be opened.

In another example, in the cooling and hot water supply operation mode, when the temperature value input from the first sensor 161 is greater than a first reference temperature value and the temperature value input from the second sensor 162 is within the normal temperature range, the controller 150 may turn on the heater 141. Even if the adjustment valves malfunction in the cooling and hot water supply operation mode, as hot water needs to be supplied through the water tank 140, hot water is produced through the heater 141.

Hereinafter, a method for controlling an air conditioner according to embodiments disclosed herein will be described with reference to FIG. 8. The method may be practiced utilizing the air conditioner according to embodiments discussed above.

Figure 8:
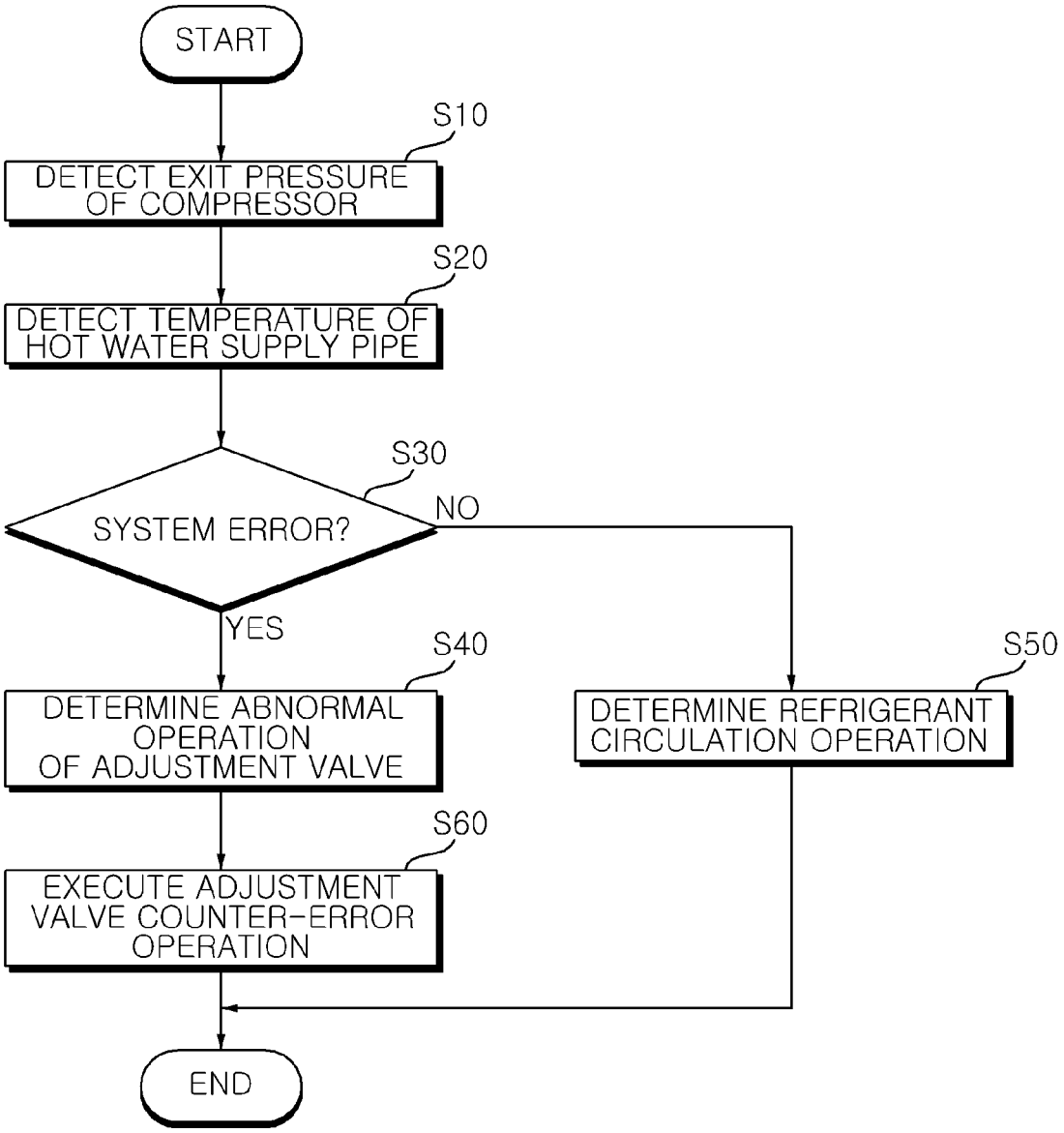
FIG. 8 is a flowchart of a method for controlling an air conditioner according to an embodiment.

FIG. 8 is a flowchart of a method for controlling an air conditioner according to an embodiment. Referring to FIG. 8, a method according to embodiments disclosed herein may include a compressor outlet temperature detecting operation (S10) of detecting an outlet temperature of compressor 111, a hot water supply pipe temperature detecting operation (S20) of detecting a change in a hot water supply pipe temperature, a system error determining operation (SS30) of determining an error in the system based on an outlet temperature of the compressor 111, and an abnormality determining operation (S40) of, in response to determination of an error in the system, determining an abnormality in an adjustment valve based on the hot water supply pipe temperature.

In the system error determining operation (S30), when the outlet temperature of the compressor 111 is greater than the first reference temperature value, a system error is determined. In the abnormality determining operation (S40), when the temperature of the hot water supply pipe is out of a normal temperature range, an abnormality in the adjustment valves is determined.

In addition, embodiments disclosed herein may further include a counter-error operation (S50) of executing an adjustment valve counter-error operation according to each operation mode when it is determined that the adjustment valves operate abnormally. The adjustment valve counter-error operation is as described above.

In addition, embodiments disclosed herein may further include a refrigerant circulation determining operation (S50) of determining whether to execute refrigerant circulation based on the hot water supply pipe temperature when a system error is not determined in the system error determining operation (S30). The refrigerant circulation is as described above.

Hereinafter, a control method of an air conditioner according to embodiments disclosed herein will be described for each operation mode with reference to FIGS. 9 to 12.

Figure 9:
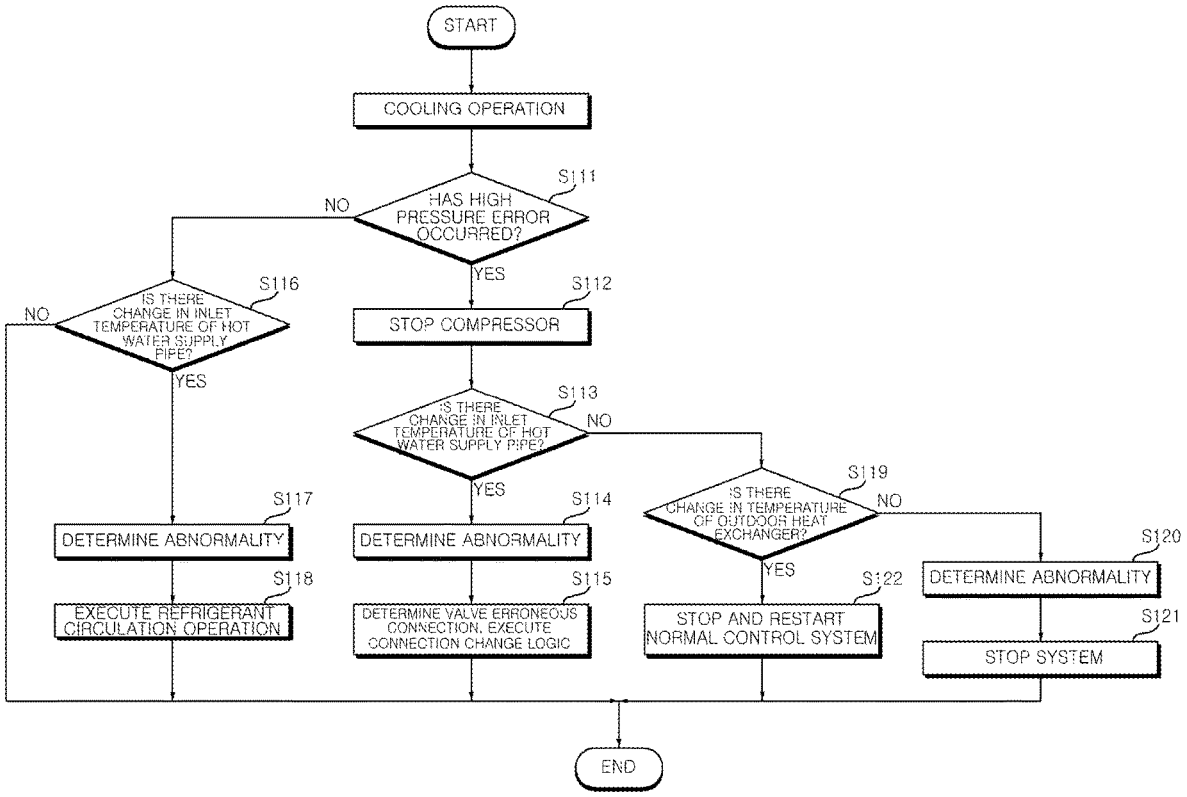
FIG. 9 is a flowchart of a control method in a cooling operation mode of the air conditioner according to an embodiment.

FIG. 9 is a flowchart of a control method in a cooling operation mode of the air conditioner according to an embodiment. More specifically, FIG. 9 shows an embodiment implemented in the cooling operation mode of the air conditioner.

In the cooling operation mode, the first adjustment valve 131 is closed, the second adjustment valve 132 is opened, the hot water supply expansion valve 123 is closed, the opening degree of the outdoor unit expansion valve 121 is adjusted to throttle refrigerant, and the indoor unit expansion valve 122 is fully opened. The four-way valve 112 supplies refrigerant compressed by the compressor 111 to the outdoor heat exchanger 113 and supplies refrigerant discharged from the indoor heat exchanger 114 to the compressor 111.

In this case, the outdoor heat exchanger 113 operates as a condenser, and the indoor heat exchanger 114 operates as an evaporator. As the first adjustment valve 131 is closed, refrigerant is not supplied to the water tank 140.

First, it is determined whether a system error has occurred in operation (S111). More specifically, the controller 150 determines whether a discharge pressure of the compressor 111 increases to or above a reference pressure. More specifically, when a temperature value input from first sensor 161 is greater than a first reference temperature value, controller 150 determines that an error has occurred in the system and stops the compressor 111 (S112).

Thereafter, it is determined whether a change in temperature of the hot water supply pipe is within a normal range (S113). More specifically, when the temperature value input from the second sensor 162 is out of the normal temperature range, the controller 150 may determine that the temperature of the hot water supply pipe is out of the normal range and determine an abnormality in the adjustment valves (S114). Then, the controller 150 may execute a connection change logic to adjust the second adjustment valve 132 in accordance with a command for the first adjustment valve 131 and adjust the first adjustment valve in accordance with a command for the second adjustment valve 132 (S115).

In addition, when no error has occurred in the system, the controller 150 may determine whether the hot water supply pipe temperature is within the normal range (S116). When it is determined that the hot water supply pipe temperature is out of the normal range (S117), the controller 150 may execute refrigerant circulation (S118). More specifically, when the temperature value input from the first sensor 161 is less than the first reference temperature value and the temperature value input from the second sensor 162 is out of the normal temperature range, the controller 150 opens the hot water supply expansion valve 123.

In addition, when an error has occurred in the system and the temperature of the hot water supply pipe is within the normal range, the controller 150 may determine a change in temperature of the outdoor heat exchanger 113 (S119), and when the change in temperature of the outdoor heat exchanger 113 is within the normal range, the controller 150 may determine an abnormality in the adjustment valves (S120) and may stop the operation of the air conditioner (S121). When an error has occurred in the system and the temperature of the hot water supply pipe is within the normal range, the controller 150 may determine a change in temperature of the outdoor heat exchanger 113 (S119), and when the change in temperature of the outdoor heat exchanger 113 is out of the normal range, the controller 150 may restart the air conditioner (S122).

Figure 10:
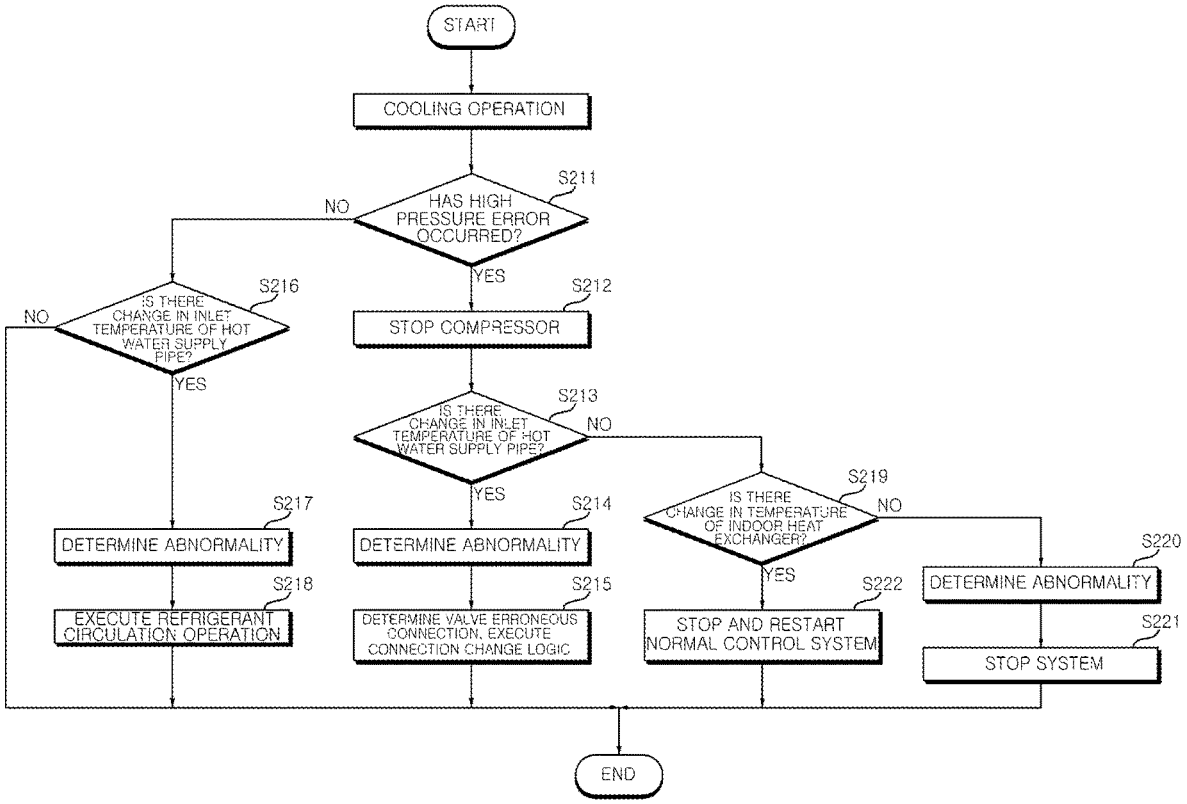
FIG. 10 is a flowchart of a control method in a heating operation mode of the air conditioner according to an embodiment.

FIG. 10 is a flowchart illustrating a control method in a heating operation mode of the air conditioner according to an embodiment. More specifically, FIG. 10 shows an embodiment implemented in the heating operation mode of the air conditioner.

In the heating operation mode, the first adjustment valve 131 is closed, the second adjustment valve 132 is opened, the hot water supply expansion valve 123 is closed, the opening value of the indoor unit expansion valve 122 is adjusted to throttle refrigerant, and the outdoor unit expansion valve 121 is fully opened. The four-way valve 112 supplies the refrigerant compressed by the compressor 111 to the indoor heat exchanger 114, and supplies the refrigerant discharged from the outdoor heat exchanger 113 to the compressor 111.

In this case, the outdoor heat exchanger 113 operates as an evaporator, and the indoor heat exchanger 114 operates as a condenser. As the first adjustment valve 131 is closed, refrigerant is not supplied to the water tank 140.

First, it is determined whether a system error has occurred (S211). More specifically, the controller 150 determines whether a discharge pressure of the compressor 111 increases to or above a reference pressure. More specifically, when a temperature value input from the first sensor 161 is greater than a first reference temperature value, the controller 150 determines that an error has occurred in the system and stops the compressor 111 (S212).

Thereafter, the controller 150 determines whether a change in temperature of the hot water supply pipe is within a normal range (S213). More specifically, when the temperature value input from the second sensor 162 is out of the normal temperature range, the controller 150 determines that the temperature of the hot water supply pipe is out of the normal range and determines an abnormality in the adjustment valves (S214). Then, the controller 150 may execute a connection change logic to adjust the second adjustment valve 132 in accordance with a command for the first adjustment valve 131 and adjust the first adjustment valve in accordance with a command for the second adjustment valve 132 (S215).

In addition, when no error has occurred in the system, the controller 150 may determine whether the hot water supply pipe temperature is within the normal range (S216), and when it is determined that the hot water supply pipe temperature is out of the normal range (S217), the controller may execute refrigerant circulation (S218). More specifically, when the temperature value input from the first sensor 161 is less than the first reference temperature value and the temperature value input from the second sensor 162 is out of the normal temperature range, the controller 150 opens the hot water supply expansion valve 123.

In addition, when an error has occurred in the system and the temperature of the hot water supply pipe is within the normal range, a change of temperature in the indoor heat exchanger 114 may be determined (S219). When the change in temperature of the indoor heat exchanger 114 is within the normal range, the controller 150 may determine an abnormality in the adjustment valves (S220) and may stop the operation of the air conditioner (S221).

In addition, when an error has occurred in the system and the temperature of the hot water supply pipe is within the normal range, a change in temperature of the indoor heat exchanger 114 may be determined (S219). When the change in temperature of the outdoor heat exchanger 113 is out of the normal range, the controller 150 may restart the air conditioner (S222).

Figure 11:
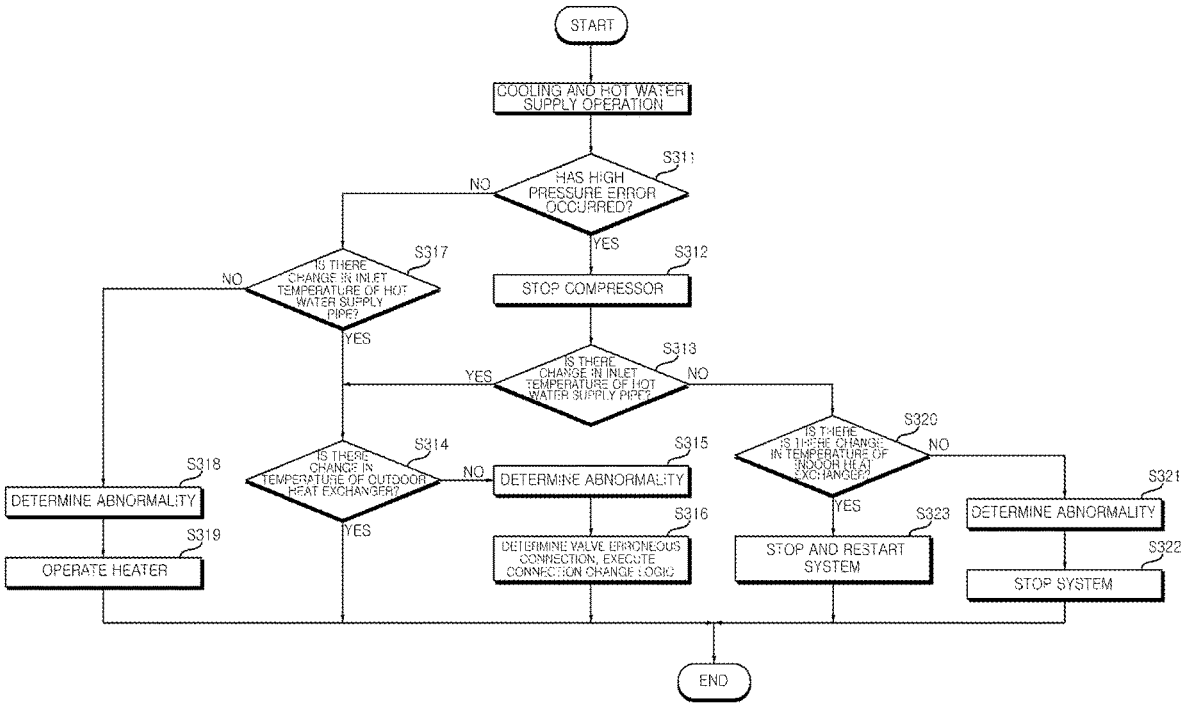
FIG. 11 is a flowchart of a control method in a cool/hot water supply operation mode of the air conditioner according to an embodiment.

FIG. 11 is a flowchart illustrating a control method in a cool/hot water supply operation mode of the air conditioner according to an embodiment. More specifically, FIG. 11 shows an embodiment implemented in the cooling and hot water supply mode of the air conditioner.

In the cooling and hot water supply operation mode, the first adjustment valve 131 is opened, the second adjustment valve 132 is opened, and the opening values of the hot water supply expansion valve 123 and the outdoor unit expansion valve 121 are adjusted to throttle refrigerant. The indoor unit expansion valve 122 is fully opened. The four-way valve 112 supplies refrigerant compressed by the compressor 111 to the outdoor heat exchanger 113 and supplies refrigerant discharged from the indoor heat exchanger 114 to the compressor 111.

In this case, the outdoor heat exchanger 113 operates as a condenser, and the indoor heat exchanger 114 operates as an evaporator. The first adjustment valve 131 is opened to supply high-temperature refrigerant to the water tank 140 to exchange heat with the water in the water tank 140.

First, it is determined whether a system error has occurred (S311). More specifically, the controller 150 determines whether a discharge pressure of the compressor 111 increases to or above a reference pressure. More specifically, when the temperature value input from the first sensor 161 is greater than the first reference temperature value, the controller 150 determines that an error has occurred in the system and stops the compressor 111 (S312).

Thereafter, it is determined whether a change in temperature of the hot water supply pipe is within a normal range (S313). More specifically, when the temperature value input from the second sensor 162 is out of the normal temperature range, the controller 150 determines that the temperature of the hot water supply pipe is out of the normal range. When it is determined that the hot water supply pipe temperature is out of the normal range, the controller 150 determines whether the temperature of the outdoor heat exchanger 113 is out of the normal range (S314). When the temperature of the outdoor heat exchanger 113 is within the normal range, the controller 150 determines an abnormality in the adjustment valves (S315) and executes a connection change logic to adjust the second adjustment valve 132 in accordance with a command for the first adjustment valve 131 and adjust the first adjustment valve in accordance with a command for the second adjustment valve 132 (S316).

In addition, if no error has occurred in the system, the controller 150 may determine whether the temperature of the hot water supply pipe is within the normal range (S317). When it is determined that the temperature of the hot water supply pipe is out of the normal range, the controller 150 may determine whether the temperature of the outdoor heat exchanger 113 is within the normal range (S314).

In addition, when no error has occurred in the system, the controller 150 may determine whether temperature of the hot water supply pipe is within the normal range (S317), and when it is determined that the temperature of the hot water supply pipe is out of the normal range (S318), the controller 150 may turn on the heater 141 (S319). More specifically, when the temperature value input from the first sensor 161 is less than the first reference temperature value and the temperature value input from the second sensor 162 is within the normal temperature range, the controller 150 may turn on the heater 141.

In addition, when an error has occurred in the system and the temperature of the hot water supply pipe is within the normal range, the controller 150 may determine whether there is a change in temperature change of the indoor heat exchanger 114 (S320). When the change in temperature of the indoor heat exchanger 114 is within the normal range, the controller 150 may determine an abnormality in the adjustment valves (S321) and may stop operation of the air conditioner (S322).

In addition, when an error has occurred in the system and the temperature of the hot water supply pipe is within the normal range, the controller 150 may determine whether there is a change in temperature of the indoor heat exchanger 114 (S320). When the change in temperature of the outdoor heat exchanger 113 is out of a normal range, the controller 150 may restart the air conditioner (S323).

Figure 12:
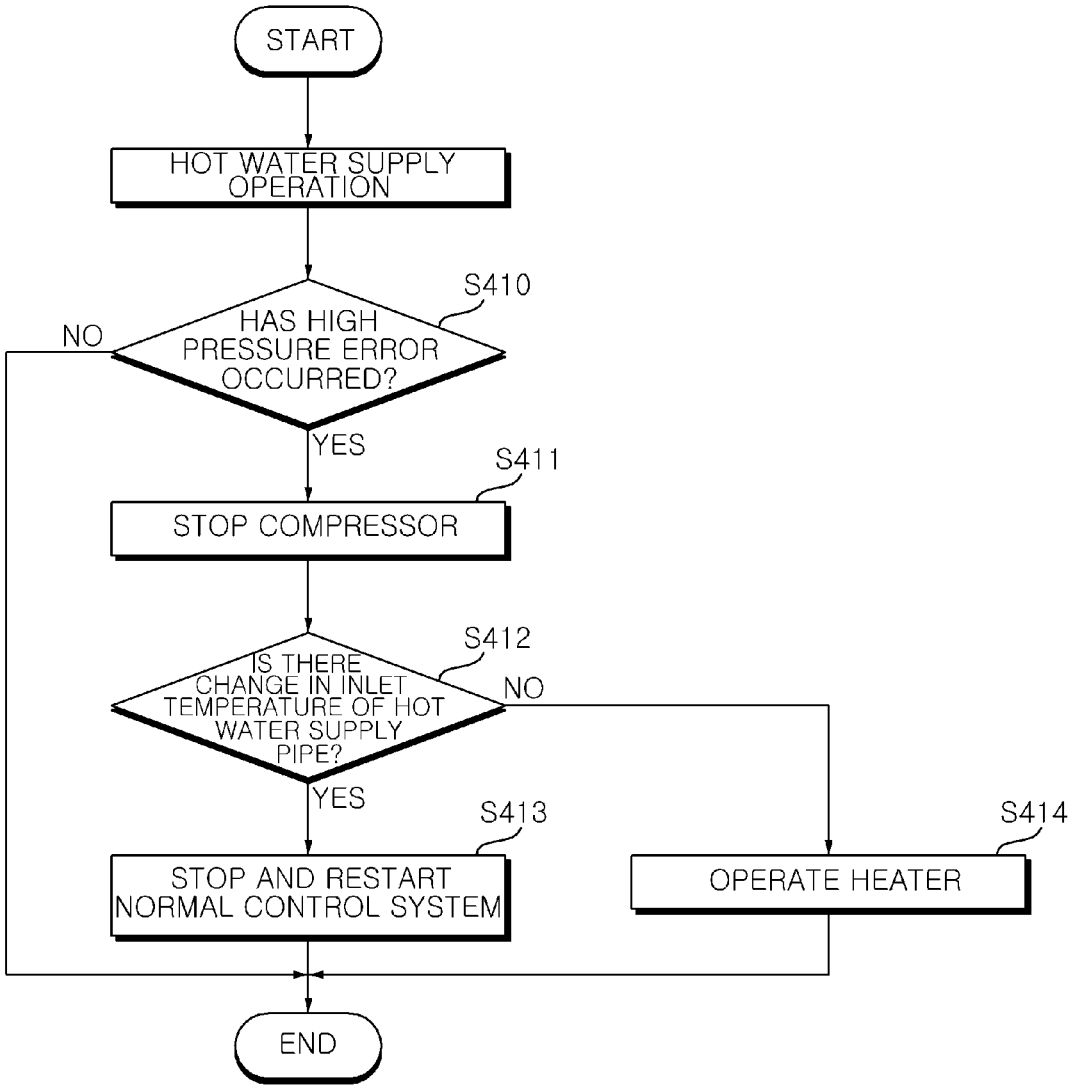
FIG. 12 is a flowchart of a control method in a hot water supply operation mode of the air conditioner according to an embodiment.

FIG. 12 is a flowchart illustrating a control method in a hot water supply operation mode of the air conditioner according to an embodiment. More specifically, FIG. 12 shows an embodiment implemented in the hot water supply operation mode of the air conditioner.

In the hot water supply operation mode, the first regulating valve 131 is opened, the second regulating valve 132 is closed, the opening degree of the hot water supply expansion valve 123 is adjusted to throttle refrigerant, the outdoor unit expansion valve 121 is fully opened, and the indoor unit expansion valve 122 is closed. The four-way valve 112 supplies refrigerant discharged from the outdoor heat exchanger 113 to the compressor 111. In this case, the outdoor heat exchanger 113 operates as an evaporator, and the water tank 140 operates as a condenser. High-temperature refrigerant compressed by the compressor 111 is condensed while exchanging heat with hot water in the water tank 140.

First, it is determined whether a system error has occurred (S410). More specifically, the controller 150 determines whether a discharge pressure of the compressor 111 increases to or above a reference pressure. More specifically, when the temperature value input from the first sensor 161 is greater than the first reference temperature value, the controller 150 may determine that an error has occurred in the system and may stop the compressor 111 (S411).

Then, the controller 150 may determine whether a change in temperature of the hot water supply pipe is within a normal range (S412). When the temperature of the hot water supply pipe is out of the normal range, the controller 150 may restart the air conditioner (S413). In addition, when the temperature of the hot water supply pipe is within the normal range, the controller 150 may turn on the heater 141 (S414).

The air conditioner according to embodiments disclosed herein has one or more of the following advantages.

The embodiments disclosed herein have the advantage of being able to quickly and simply detect an error in adjustment valves with only temperature values sensed by a plurality of sensors.

Further, embodiments disclosed herein determine whether an adjustment valve operates abnormally according to each operation mode and performs an adjustment valve counter-error operation according to each operation mode, and therefore, it is not necessary to stop the system due to an error in every adjustment valve. Accordingly, embodiments disclosed herein have advantages of being able to reduce inconvenience to consumers and perform an operation to solve an error while protecting the air conditioner in various situations occurring in each operation mode.

Furthermore, embodiments disclosed herein do not stop the system in the case of a problem that can be solved by software according to each operation mode, but instead lets the software solve the problem, thereby improving user convenience and reducing repair costs.

In addition, if refrigerant is accumulated in the water tank due to a malfunction of an adjustment valve and there is overall insufficient refrigerant in the air conditioner, reducing efficiency of the system, and in this regard, the embodiments disclosed herein have the advantage of circulating the refrigerant through refrigerant circulation, thereby preventing efficiency degradation of the system.

Also, in embodiments disclosed herein, even if an adjustment valve malfunctions in the cooling and hot water supply operation mode, as hot water needs to be supplied through the water tank, the hot water is produced through a heater, and therefore, embodiments disclosed herein have the advantage of supplying the hot water even when a valve malfunctions.

Embodiments disclosed herein provide an air conditioner capable of quickly and simply detecting an error in an adjustment valve using a plurality of temperature sensors. Embodiments disclosed herein also provide an air conditioner capable of performing an operation for solving an error, without a need to stop the system in the event of an error in every adjustment valve, while protecting the air conditioner in various situations occurring in each operation mode.

Embodiments disclosed herein further provide an air conditioner capable of solving a problem in terms of software, without stopping the system, in the event that the problem that can be solved by software according to each operation mode. Embodiments disclosed herein furthermore provide an air conditioner capable of preventing damage to the air conditioner caused by a malfunction of an adjustment valve and supplying cold or hot water of the air conditioner when the adjustment valves malfunctions.

Embodiments disclosed herein may include a first sensor configured to detect a temperature of refrigerant discharged from the compressor; a second sensor configured to detect a temperature of refrigerant supplied to a water tank; and a controller configured to determine an abnormality in the first adjustment valve and the second adjustment valve based on temperature values respectively input from the first sensor and the second sensor. More specifically, embodiments disclosed herein provide an air conditioner that may include a compressor that compresses a refrigerant; an outdoor heat exchanger; an indoor heat exchanger; a four-way valve that selectively supplies the refrigerant compressed by the compressor to the outdoor or indoor heat exchanger; a water tank that generates hot water by performing heat exchange with refrigerant; a first adjustment valve that selectively supplies the refrigerant compressed by the compressor to the water tank; a second adjustment valve that selectively supplies the refrigerant compressed by the compressor to the four-way valve; a first sensor configured to detect a temperature of refrigerant discharged from the compressor; a second sensor configured to sense temperature of refrigerant supplied to the water tank; and a controller configured to determine an abnormality in the first adjustment valve and the second adjustment valve based on temperature values respectively input from the first sensor and the second sensor. The controller may stop the compressor when a temperature value input from the first sensor is greater than a first reference temperature value.

When the temperature value input from the first sensor is greater than a first reference temperature value, the controller may determine the abnormality in the adjustment valves according to each operation mode based on the temperature value input from the second sensor. When the abnormality in the adjustment valves is determined, the controller may control to perform an adjustment valve counter-error operation according to each operation mode.

In the adjustment valve counter-error operation, the controller may control the second adjustment valve in accordance with a command for the first adjustment valve and control the first adjustment valve in accordance with a command for the second adjustment valve. Further, in the adjustment valve counter-error operation, the controller may stop the air conditioner.

When the temperature value input from the first sensor is greater than a first reference temperature value and the temperature value input from the second sensor is out of a normal temperature range, the controller may control the second adjustment valve in accordance with a command for the first adjustment valve and control the first adjustment valve in accordance with a command for the second adjustment valve.

When the temperature value input from the first sensor is less than a first reference temperature value, the controller may determine whether the adjustment valves operates abnormally according to each operation mode. When an abnormality in the adjustment valves is determined, the controller may control to perform a refrigerant circulation operation according to each operation mode.

The air conditioner may further include a hot water supply expansion valve disposed at a pipe connecting the water tank and the outdoor heat exchanger. The refrigerant circulation may include opening the hot water supply expansion valve.

The air conditioner may further include a hot water supply expansion valve disposed at a pipe connecting the water tank and the outdoor heat exchanger. In the cooling operation mode or the heating operation mode, when the temperature value input from the first sensor is less than a first reference temperature value and the temperature value input from the second sensor is out of a normal temperature range, the controller may control the hot water supply expansion valve to be opened.

The air conditioner may further include a heater disposed in the water tank. In the cooling and hot water supply operation mode, when the temperature value input from the first sensor is greater than a first reference temperature value and the temperature value input from the second sensor is within a normal temperature range, the controller may turn on the heater.

The air conditioner may further include a third sensor configured to detect a temperature of refrigerant passing through the outdoor heat exchanger. In the cooling operation mode, when a temperature value input from the first sensor is greater than a first reference temperature value, the temperature value input from the second sensor is in a normal temperature range, and the temperature value input from the third sensor is within the normal temperature range, the controller may stop the air conditioner.

In the cooling operation mode, when the temperature value input from the first sensor is greater than a first reference temperature value, the temperature value input from the second sensor is within a normal temperature range, and the temperature value input from the third sensor is out of the normal temperature range, the controller may restart the air conditioner.

The air conditioner may further include a fourth sensor configured to detect a temperature of the refrigerant passing through the indoor heat exchanger. In the heating operation mode, when the temperature value input from the first sensor is greater than a first reference temperature value, the temperature value input from the second sensor is within a normal temperature range, and the temperature value input from the fourth sensor is within the normal temperature range, the controller may stop the air conditioner. In the heating operation mode, when the temperature value input from the first sensor is greater than a first reference temperature value, the temperature value input from the second sensor is within a normal temperature range, and the temperature value input from the fourth sensor is out of the normal temperature range, the controller may restart the air conditioner.

Embodiments disclosed herein also provide a control method of an air conditioner. The method may include a compressor outlet temperature detecting step or operation of detecting an outlet temperature of a compressor; a hot water supply pipe temperature detecting step or operation of detecting a change in temperature of a hot water supply pipe; a system error determining step or operation of determining a system error based on the outlet temperature of the compressor; and an abnormality determining step or operation of determining an abnormality in an adjustment valve based on the temperature of the hot water supply pipe when a system error is determined. In the system error determining step or operation, when the outlet temperature of the compressor is greater than a first reference temperature value, a system error may be determined. In the abnormality determining step or operation, when the temperature of the hot water supply pipe is out of a normal temperature range, an abnormality in the adjustment valves may be determined.

The control method may further include a counter-error operation step or operation of executing an adjustment valve counter-error operation according to each operation mode when an abnormality in the adjustment valves is determined. In addition, the control method may further include a refrigerant circulation determining step or operation of determining whether to execute a refrigerant circulation based on the temperature of the hot water supply pipe when a system error is determined.

The adjustment valve counter-error operation may include adjusting a second adjustment valve in accordance with a command for a first adjustment valve and adjusting the first adjustment valve in accordance with a command for the second adjustment valve.

Embodiments disclosed herein also provide an air conditioner that may include a compressor that compresses refrigerant; an outdoor heat exchanger; an indoor heat exchanger; a switching part that selectively supplies the refrigerant compressed by the compressor to the outdoor heat exchanger or indoor heat exchanger; a water tank generating hot water by that performs heat exchange with the refrigerant; a first adjustment valve that selectively supplies the refrigerant compressed by the compressor to the water tank; a second adjustment valve that selectively supplies the refrigerant compressed by the compressor to the switching part; a first sensor configured to detect a temperature of refrigerant discharged from the compressor; a second sensor configured to detect a temperature of refrigerant supplied to the water tank; and a controller configured to control at least one of the first adjustment valve, the second adjustment valve, or the compressor based on temperature values respectively input from the first sensor and the second sensor. The controller may stop the compressor when the temperature value input from the first sensor is greater than a first reference temperature value.

The above described features, configurations, and effects, for example, are included in at least one of the embodiments disclosed herein, and should not be limited to only one embodiment. In addition, the features, configurations, and effects, for example, as illustrated in each embodiment may be implemented with regard to other embodiments as they are combined with one another or modified by those skilled in the art. Thus, content related to these combinations and modifications should be construed as including in the scope and spirit as disclosed in the accompanying claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank; and a controller configured to determine an abnormality in the first adjustment valve and the second adjustment valve based on temperature values respectively input from the first sensor and the second sensor, wherein when the temperature value input from the first sensor is greater than a first reference temperature value, the controller determines the abnormality in the adjustment valves according to each operation mode based on the temperature value input from the second sensor, and when the abnormality in the adjustment valves are determined, the controller controls to perform an adjustment valve counter-error operation according to each operation mode.

2. The air conditioner of claim 1, wherein when the temperature value input from the first sensor is greater than the first reference temperature value, the controller stops the compressor.

3. The air conditioner of claim 1, wherein in the adjustment valve counter-error operation, the controller controls the second adjustment valve in accordance with a command for the first adjustment valve and controls the first adjustment valve in accordance with a command for the second adjustment valve.

4. The air conditioner of claim 1, wherein in the adjustment valve counter-error operation, the controller stops the air conditioner.

5. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank; and a controller configured to determine an abnormality in the first adjustment valve and the second adjustment valve based on temperature values respectively input from the first sensor and the second sensor, wherein when the temperature value input from the first sensor is greater than a first reference temperature value and the temperature value input from the second sensor is out of a normal temperature range, the controller controls the second adjustment valve in accordance with a command for the first adjustment valve and controls the first adjustment valve in accordance with a command for the second adjustment valve.

6. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank; and a controller configured to determine an abnormality in the first adjustment valve and the second adjustment valve based on temperature values respectively input from the first sensor and the second sensor, wherein when the temperature value input from the first sensor is less than a first reference temperature value, the controller determines whether the adjustment valves operate abnormally according to each operation mode, and when an abnormality in the adjustment valves is determined, the controller controls to perform a refrigerant circulation operation according to each operation mode.

7. The air conditioner of claim 6, further comprising:

a hot water supply expansion valve disposed at a pipe connecting the water tank and the outdoor heat exchanger, wherein refrigerant circulation comprises opening the hot water supply expansion valve.

8. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank;

a controller configured to determine an abnormality in the first adjustment valve and the second adjustment valve based on temperature values respectively input from the first sensor and the second sensor; and a hot water supply expansion valve disposed at a pipe connecting the water tank and the outdoor heat exchanger, wherein in a cooling operation mode or a heating operation mode, when the temperature value input from the first sensor is less than a first reference temperature value and the temperature value input from the second sensor is out of a normal temperature range, the controller controls the hot water supply expansion valve to be opened.

9. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank;

a controller configured to determine an abnormality in the first adjustment valve and the second adjustment valve based on temperature values respectively input from the first sensor and the second sensor; and a heater disposed in the water tank, wherein in a cooling and hot water supply operation mode, when the temperature value input from the first sensor is greater than a first reference temperature value and the temperature value input from the second sensor is within a normal temperature range, the controller turns on the heater.

10. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank;

a controller configured to determine an abnormality in the first adjustment valve and the second adjustment valve based on temperature values respectively input from the first sensor and the second sensor; and a third sensor configured to detect a temperature of refrigerant passing through the outdoor heat exchanger, wherein in a cooling operation mode, when the temperature value input from the first sensor is greater than a first reference temperature value, the temperature value input from the second sensor is in a normal temperature range, and a temperature value input from the third sensor is within the normal temperature range, the controller stops the air conditioner.

11. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank;

a controller configured to determine an abnormality in the first adjustment valve and the second adjustment valve based on temperature values respectively input from the first sensor and the second sensor; and a third sensor configured to detect a temperature of refrigerant passing through the outdoor heat exchanger, wherein in a cooling operation mode, when the temperature value input from the first sensor is greater than a first reference temperature value, the temperature value input from the second sensor is within a normal temperature range, and the temperature value input from the third sensor is out of the normal temperature range, the controller restarts the air conditioner.

12. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank;

a controller configured to determine an abnormality in the first adjustment valve and the second adjustment valve based on temperature values respectively input from the first sensor and the second sensor; and a third sensor configured to detect a temperature of the refrigerant passing through the indoor heat exchanger, wherein in a heating operation mode, when the temperature value input from the first sensor is greater than a first reference temperature value, the temperature value input from the second sensor is within a normal temperature range, and a temperature value input from the third sensor is within the normal temperature range, the controller stops the air conditioner.

13. An air conditioner, comprising:

a compressor that compresses a refrigerant;

an outdoor heat exchanger;

an indoor heat exchanger;

a four-way valve that selectively supplies the refrigerant compressed by the compressor to the outdoor heat exchanger or the indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the four-way valve;

a first sensor configured to detect a temperature of the refrigerant discharged from the compressor;

a second sensor configured to detect a temperature of the refrigerant supplied to the water tank;

a controller configured to determine an abnormality in the first adjustment valve and the second adjustment valve based on temperature values respectively input from the first sensor and the second sensor; and a third sensor configured to detect a temperature of the refrigerant passing through the indoor heat exchanger, wherein in a heating operation mode, when the temperature value input from the first sensor is greater than a first reference temperature value, the temperature value input from the second sensor is within a normal temperature range, and a temperature value input from the third sensor is out of the normal temperature range, the controller restarts the air conditioner.

14. An air conditioner, comprising:

a compressor that compresses a refrigerant;

an outdoor heat exchanger;

an indoor heat exchanger;

a switching valve that selectively supplies the refrigerant compressed by the compressor to the outdoor heat exchanger or indoor heat exchanger;

a water tank that generates hot water by exchanging heat with the refrigerant;

a first adjustment valve that selectively supplies the refrigerant compressed by the compressor to the water tank;

a second adjustment valve that selectively supplies the refrigerant compressed by the compressor to the switching valve;

a first sensor configured to detect a temperature of the refrigerant discharged from the compressor;

a second sensor configured to detect a temperature of the refrigerant supplied to the water tank; and a controller configured to control at least one of the first adjustment valve, the second adjustment valve, or the compressor based on temperature values respectively input from the first sensor and the second sensor, wherein the controller stops the compressor when the temperature value input from the first sensor is greater than a first reference temperature value, and wherein when the temperature value input from the first sensor is greater than a first reference temperature value and the temperature value input from the second sensor is out of a normal temperature range, the controller controls the second adjustment valve in accordance with a command for the first adjustment valve and controls the first adjustment valve in accordance with a command for the second adjustment valve.

15. A method for controlling an air conditioner, the method comprising:

detecting an outlet temperature of a compressor;

detecting a change in temperature of a hot water supply pipe;

determining a system error based on the outlet temperature of the compressor; and determining an abnormality in an adjustment valve based on the temperature of the hot water supply pipe when the system error is determined, wherein in the determining of the system error, when the outlet temperature of the compressor is greater than a first reference temperature value, a system error is determined, wherein in the determining of the abnormality, when the temperature of the hot water supply pipe is out of a normal temperature range, an abnormality in the adjustment valves is determined, and wherein the method further comprises:

executing an adjustment valve counter-error operation according to each operation mode when an abnormality in the adjustment valves is determined.

16. The method of claim 15, further comprising:

determining whether to execute a refrigerant circulation based on the temperature of the hot water supply pipe when a system error is determined.

* * * * *